US010894636B2

(12) United States Patent
Duquet et al.

(10) Patent No.: US 10,894,636 B2
(45) Date of Patent: Jan. 19, 2021

(54) AXIAL MAGNETIC ATTRACTION DEVICE

(71) Applicant: APTAR FRANCE SAS, Le Neubourg (FR)

(72) Inventors: Frederic Duquet, Crespieres (FR); Thierry Hondier, Bosc-Benard Crecy (FR)

(73) Assignee: APTAR FRANCE SAS, Le Neubourg (FR)

( * ) Notice: Subject to any disclaimer, the term of this patent is extended or adjusted under 35 U.S.C. 154(b) by 129 days.

(21) Appl. No.: 15/578,002

(22) PCT Filed: Jun. 13, 2016

(86) PCT No.: PCT/FR2016/051417
§ 371 (c)(1),
(2) Date: Nov. 29, 2017

(87) PCT Pub. No.: WO2016/203143
PCT Pub. Date: Dec. 22, 2016

(65) Prior Publication Data

US 2018/0290794 A1 Oct. 11, 2018

(30) Foreign Application Priority Data

Jun. 18, 2015 (FR) ..... 15 55593

(51) Int. Cl.
*B65D 47/18* (2006.01)
*B65D 41/58* (2006.01)
(Continued)

(52) U.S. Cl.
CPC ..... *B65D 45/02* (2013.01); *B65D 47/04* (2013.01); *B65D 2313/04* (2013.01)

(58) Field of Classification Search
CPC .... B65D 45/02; B65D 47/04; B65D 2313/04; B65D 41/58; B65D 51/18; B65D 41/62;
(Continued)

(56) References Cited

U.S. PATENT DOCUMENTS 5,876,137 A * 3/1999 Byrd ..... A45D 40/06 215/222
8,317,048 B2 * 11/2012 Hajichristou ..... B65D 43/0225 220/230

(Continued)

FOREIGN PATENT DOCUMENTS

DE 1190349 B * 4/1965 ..... B65D 41/023
DE 102011050774 A1 * 12/2012 ..... B65D 43/0202

(Continued)

OTHER PUBLICATIONS

International Search Report for PCT/FR2016/051417 dated Sep. 20, 2016 [PCT/ISA/210].

(Continued)

*Primary Examiner* — Allan D Stevens
(74) *Attorney, Agent, or Firm* — Sughrue Mion, PLLC

(57) ABSTRACT

A device having a base part (1) and a removable member (3) that is mounted in removable manner on the base part (1), the base part (1) and the removable member (3) including a magnetic means (15, 35) that generates axial magnetic attraction between them that is at its maximum in an assembled rest position. The device further includes a mover means (4), distinct from the removable member (3), for moving the removable member (3) axially away from the base part (1), starting from the assembled rest position, by turning an actuator member (7) that forms part of the mover means (4), so as to reduce the magnetic attraction between the base part (1) and the removable member (3), and thus facilitate the removal of the removable member (3).

13 Claims, 3 Drawing Sheets

(51) Int. Cl.
*B65D 45/02* (2006.01)
*B65D 47/04* (2006.01)

(58) Field of Classification Search
CPC ..... B65D 45/00; B65D 50/04; B65D 41/04; B65D 41/0471; B65D 47/18; B65D 47/121; B65D 47/12; B65D 47/125; B65D 47/14; B65D 47/0819; B65D 47/141; B65D 2251/0012; B65D 2251/0087; B65D 43/12; A45D 34/00; A45D 34/04; A45D 40/26; B05B 11/00
USPC ..... 220/230, 295, 293, 288, 301; 215/331, 215/330, 329, 316, 214; 222/410, 411, 222/412
See application file for complete search history.

(56) References Cited

U.S. PATENT DOCUMENTS 9,089,868 B2 * 7/2015 Lee ..... A45D 34/04
2014/0252043 A1 * 9/2014 Pouliaude ..... B05B 11/0008 222/321.9
2016/0176590 A1 * 6/2016 Prater ..... B65D 50/041 206/525

FOREIGN PATENT DOCUMENTS

EP 2 334 571 A1 10/2012
FR 2731985 A1 * 9/1996 ..... B65D 41/02
FR 2800040 A1 * 4/2001 ..... B65D 83/40
FR 2973004 A1 * 9/2012 ..... B65D 51/00
FR 2973665 A1 * 10/2012 ..... B65D 43/26
FR 3030461 A1 * 6/2016 ..... A45D 34/00
WO 2010/018431 A1 2/2010
WO WO-2011085089 A2 * 7/2011 ..... A61B 5/150351

OTHER PUBLICATIONS

International Preliminary Report on Patentability and Translation of Written Opinion, dated Dec. 28, 2017 from the International Bureau in counterpart International application No. PCT/FR2016/051417.

* cited by examiner

AXIAL MAGNETIC ATTRACTION DEVICE

CROSS REFERENCE TO RELATED APPLICATIONS

This application is a National Stage of International Application No. PCT/FR2016/051417, filed on Jun. 13, 2016, which claims priority from French Patent Application No. 15 55593, filed on Jun. 18, 2015, the contents of all of which are incorporated herein by reference in their entirety.

FIELD OF THE INVENTION

The present invention relates to a device comprising a base part and a removable member that is mounted in removable manner on the base part, the base part and the removable member including magnetic means that are suitable for generating axial magnetic attraction between them that is at its maximum in an assembled rest position. Advantageous fields of application of the present invention are the fields of perfumery, cosmetics, and pharmacy. The base part may be secured to a fluid reservoir, and the movable member may be a stopper, an applicator, or a protective cap.

BACKGROUND

In the field of perfumery, document FR 1 046 488 is known, which describes a reservoir provided with a base part that incorporates three magnets, each having a north pole and a south pole. The base part is mounted around the neck of the reservoir that defines an opening that puts the inside of the reservoir into communication with the outside. In order to close the opening, provision is made for a cap (removable member) that is provided with three ferromagnetic plates that are arranged in corresponding manner with the three magnets of the base part that is mounted around the neck of the reservoir. When the cap is positioned on the base part, each of the three ferromagnetic plates is arranged above its respective corresponding magnet. The angular orientation of the cap relative to the base part is imposed in this way.

When the user wises to remove the cap from the base part, the cap is gripped and pulled axially, so as to pull it off the base part. To do this, the user must overcome the axial magnetic attraction that is generated between the magnets and the ferromagnetic plates. It is clear that the magnetic attraction is at its maximum when the cap is in contact with the base part. Consequently, the user must overcome this maximum magnetic attraction by pulling hard on the cap. Once the cap has separated from the base part, the magnetic attraction falls off quickly as a result of it depending on the square of the distance. As a result, pulling the cap off can lead to a hand action that is rough, and that may cause fluid to leave the reservoir, or drops of fluid on the cap to be lost. And even when pulling the cap off does not cause any difficulty, the user nevertheless perceives the hand action as complicated, clumsy, or dangerous. The heavy handedness resulting from pulling the cap off is also in contrast to the image that it is desired to impart to the dispenser, in particular when the dispenser is for dispensing a fragrance.

In the prior art, document FR 2 800 040 is also known, which describes a fluid dispenser including a protective cap that is mounted on a base part by using magnetic means that make it possible to orientate the cap relative to the base part. Once again, the north and south poles of magnets are used to impose the angular orientation of the protective cap relative to the base part. The same pulling-off problem thus exists as in the above-mentioned document.

Document U.S. Pat. No. 8,636,039 is also known, which describes a fluid dispenser including a pusher that is mounted in removable manner on a valve rod of a pump by using magnetic means. Here too, pulling off the pusher requires a hand action that is relatively rough, which is not appropriate for the image expected of a fragrance dispenser.

In the prior art, document EP 2 334 571 A1 is also known, which describes a pot that is surmounted by a lid, with magnets holding them together. Furthermore, the pot forms a sinuous cam path, and the lid includes a radial lug that follows the cam path while the lid is being turned, thereby decreasing the magnetic attraction between the pot and its lid. In that document, the user acts directly on the lid so as to turn it.

In the above-mentioned prior art, a dilemma thus exists between the need for a stable and solid connection and the desire for hand action while opening that is not too heavy handed. In other words, when powerful magnetic means are used to guarantee good connection, considerable pulling-off force is required. In contrast, when it is desired to have hand action that is gentle while opening, it is necessary to use magnetic means that are weak, which do not guarantee a reliable connection.

NON-LIMITING OBJECTS AND SUMMARY OF THE INVENTION

An object of the present invention is to remedy the above-mentioned drawbacks of the prior art by defining a magnetic connection device for magnetically connecting a removable member on a base part, in which the removable member does not need to be pulled off hard in order to be removed. An object of the present invention is to be able to overcome the maximum magnetic attraction, without needing to apply a corresponding axial pulling-off force. Another object of the present invention is to avoid using the north and south poles. Still another object of the present invention is to guarantee automatic repositioning of the removable member on the base part.

To achieve these various objects, the device of the present invention further comprises mover means, distinct from the removable member, for moving the removable member axially away from the base part, starting from the assembled rest position, by turning an actuator member that forms part of the mover means, so as to reduce the magnetic attraction between the base part and the removable member, and thus facilitate the removal of the removable member. In other words, the user causes the actuator member to turn about its own axis, thereby directly causing the removable member to lift axially off the base part, without any turning component. Such mover means are already known in the art for transforming a turning movement into an axial movement in translation. However, they have never been used to move a removable member against an axial magnetic attraction.

In a practical embodiment, the mover means comprise an axial guide bushing that is mounted in stationary manner on the base part, an axial thrust cylinder that is guided axially by the axial guide bushing, and the actuator member that is rotatably mounted on the axial guide bushing, cam means being provided between the actuator member and the axial thrust cylinder so as to urge the axial thrust cylinder in axial movement guided by the axial guide bushing while the actuator member is being turned. Advantageously, the axial guide bushing includes at least one axial cut-out, and the axial thrust cylinder includes at least axial guide profile that is engaged in said at least one axial cut-out so as to guide the axial thrust cylinder in axial movement, while preventing it from turning. Still more advantageously, the cam means comprise at least one sloping ramp that is formed by the actuator member, and the axial thrust cylinder includes at least one lug that is engaged in said at least one sloping ramp so as to force the lug to move along the sloping ramp while the actuator member is turning. Preferably, the sloping ramp presents a slope such that the removable member returns automatically to the assembled rest position under the action of magnetic attraction, when it is placed on the axial thrust cylinder. The user may possibly push a little on the removable member until feeling that it is moving on its own under the effect of magnetic attraction. Naturally, in order to be able to remove the removable member completely from the base part, it is necessary for the sloping ramp to be open at its top end, so as to enable the lug to be engaged.

In another practical aspect of the invention, the actuator member may comprise an inner ring that forms said at least one sloping ramp, and an outer hoop that is engaged around the inner ring. This is a practical configuration that makes it possible to make the sloping ramp out of a part made of plastics material and to make the outer hoop out of metal.

In the context of the present invention, the base part may be mounted on a reservoir neck, and the movable member is selected from stoppers, applicators, and protective caps. It is even possible to envisage implementing the present invention with a pusher that is mounted on an actuator rod of a pump or a valve.

Advantageously, the base part includes a skirt that is engaged around the neck of the reservoir, the axial guide bushing being mounted around the skirt so as to block it around the neck. Thus, the axial guide bushing performs an additional function of blocking or locking the skirt of the ring around the neck that is conventionally made with outer annular reinforcement.

In another advantageous aspect of the invention, the movable member is received entirely in the actuator member in the assembled rest position. Thus, it is protected inside the actuator member. It cannot be pulled off in accidental or untimely manner.

In a practical embodiment, the magnetic means comprise a permanent magnet that is secured to the base part and a movable magnet that is secured to the movable member, a sealing gasket being interposed between the two magnets in the assembled rest position so as to be flattened by the axial magnetic attraction.

Still in a practical spirit, the movable member may include a shoulder below which the axial thrust cylinder is engaged.

In an embodiment, the movable member may include a blind extraction and application space that is engaged in the neck of the reservoir in the assembled rest position.

The spirit of the invention resides in using a mechanical cam, distinct from the removable member (closure) (3), for overcoming the maximum magnetic attraction, without recourse to pulling off the movable member axially. The mechanical cam transforms the pure turning of an actuator member into a pure axial movement (without turning) of the movable member.

BRIEF DESCRIPTION OF THE DRAWINGS

The invention is described below in greater detail with reference to the accompanying drawings, which show an embodiment of the invention by way of non-limiting example.

In the figures.

DETAILED DESCRIPTION OF NON-LIMITING EMBODIMENTS OF THE INVENTION

Figure 2:
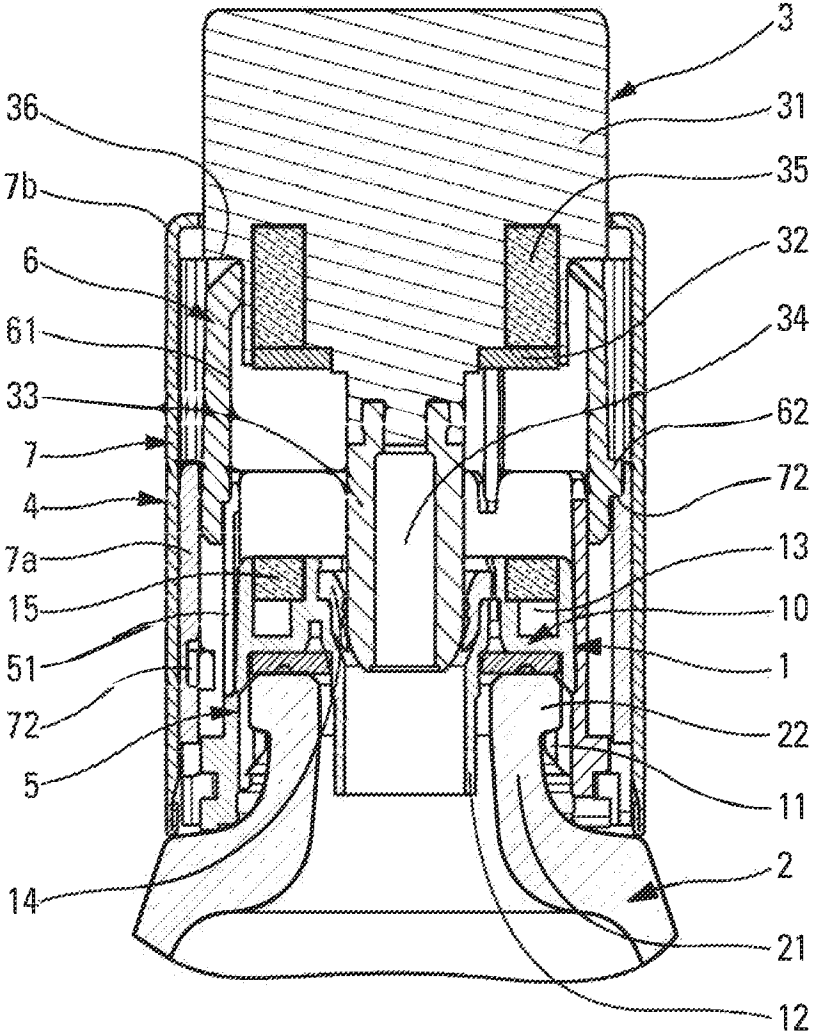
FIG. 2 is a view similar to the view in FIG. 1, in its separated extracted position.
Figure 1:
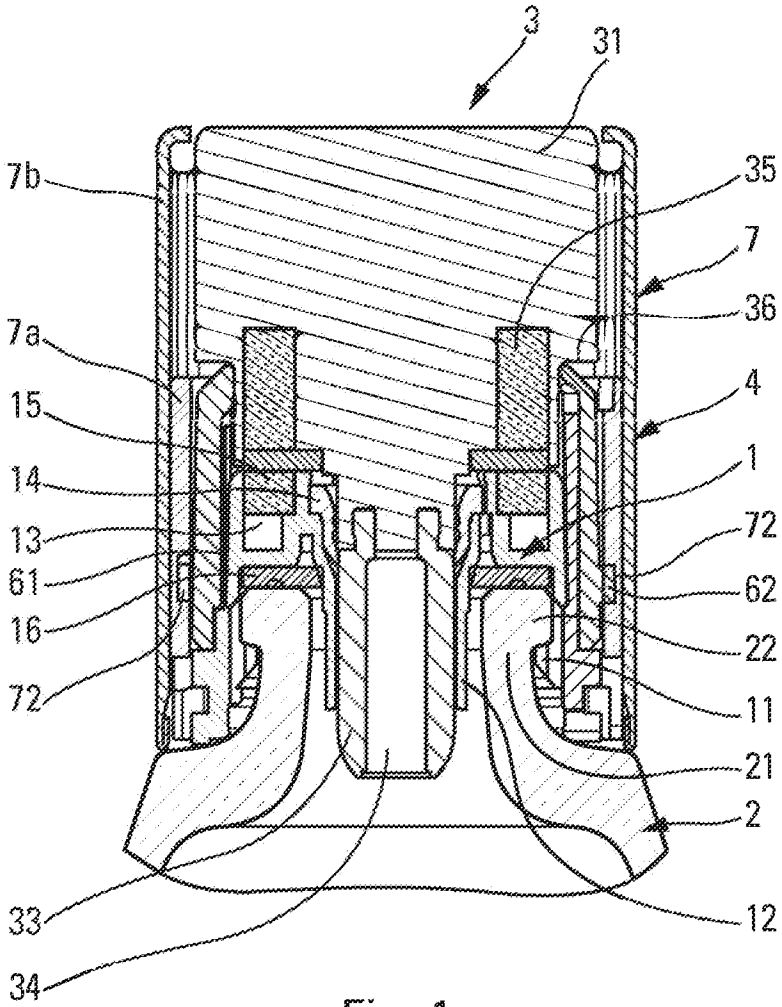
FIG. 1 is a vertical section view through a dispenser of the invention in the assembled rest position.

As can be seen in FIGS. 1 and 2, a fluid dispensing device, also referred to as a dispenser, of the invention comprises a base part 1 on which there is mounted a removable member (also referred to as the movable member) 3, the two parts being held together, in their assembled rest position, by magnetic means that are suitable for generating an axial attraction between them. In the embodiment that is used to illustrate the present invention, the base part 1 is mounted on a fluid reservoir 2, and the movable member 3 forms a stopper that is provided with an applicator 33. In order to move the movable member 3 relative to the base part 1, the present invention provides mover means for moving mechanism) 4 that are secured to the base part, but that are suitable for urging the movable member 3 in axial movement, without any turning component, starting from the assembled rest position, in which magnetic attraction is at its maximum.

Figure 3:
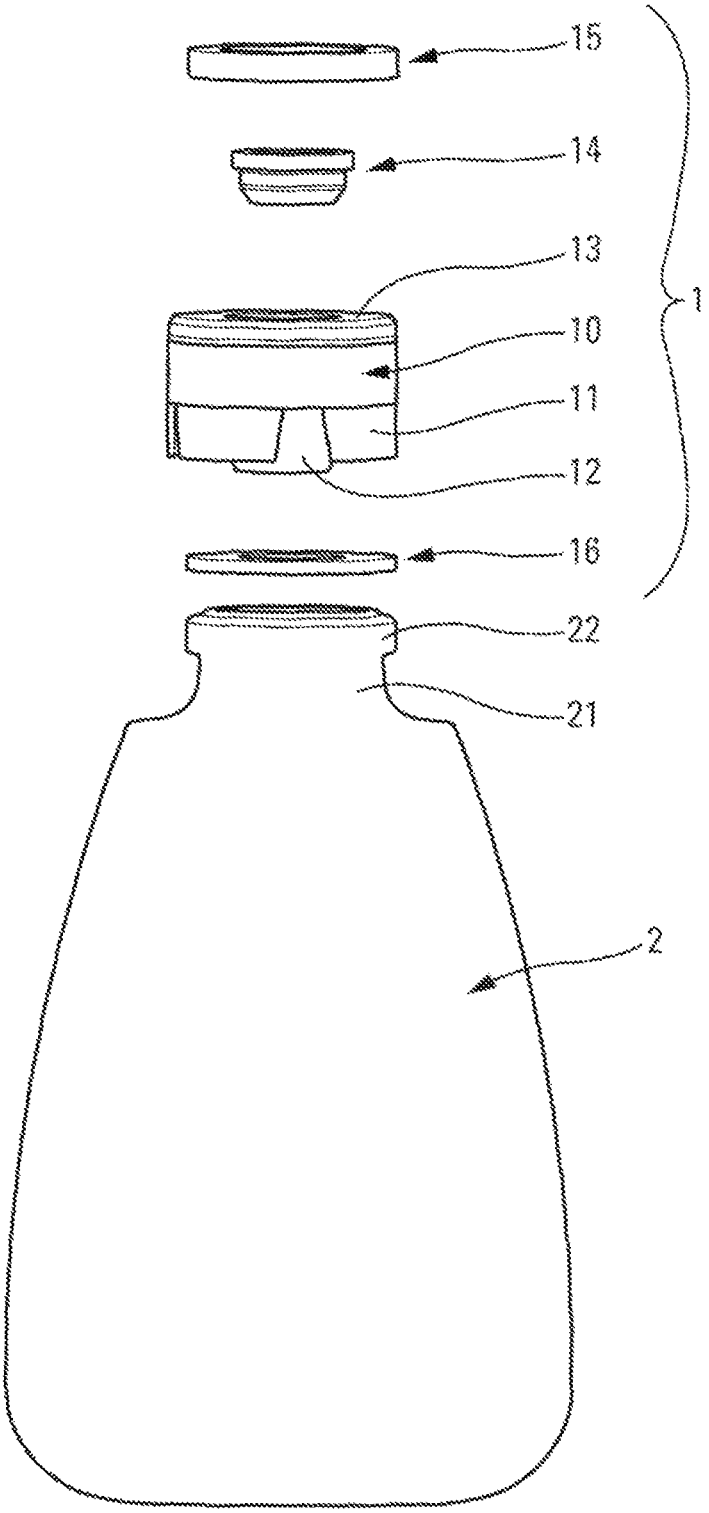
FIG. 3 is an exploded perspective view of a base part, ready to be mounted on a fluid reservoir.

Reference is made firstly to FIG. 3 in order to describe in detail the base part 1 and its co-operation with the fluid reservoir. Firstly, the reservoir 2 may be made of any appropriate material, (glass, metal, plastics material, ceramic, etc.) and may present any shape. It may be transparent or opaque. At its top end, it defines a neck 21 that is provided with projecting annular reinforcement 22, as is extremely conventional in the fields of perfumery and cosmetics. The reservoir 2 may be filled with a fluid, preferably of low viscosity, such as fragrance, a lotion, a serum, etc.

In this particular embodiment, the base part 1 includes a fastener ring 10 that forms a fastener skirt 11 for coming into engagement around the neck 21, so as to become housed below the annular reinforcement 22. In this embodiment, the skirt 11 is slotted, but it may also be continuous. The fastener ring 10 also includes a guide sleeve 12 that extends inside the neck 21, as can be seen in FIGS. 1 and 2. Its function is explained below. The ring 10 also forms a reception housing 13 for receiving a stationary magnet 15. The ring 10 may also be provided with a scraper lip 14 that is arranged just above the guide sleeve 12. The ring 10 is also fitted with a neck gasket 16 for being flattened against the top annular edge of the neck 21 of the reservoir 2. As seen from above, the base part 1 forms a central opening that is defined by the guide sleeve 12 and by the scraper lip 14, the opening being bordered by the stationary magnet 15.

Figure 6:
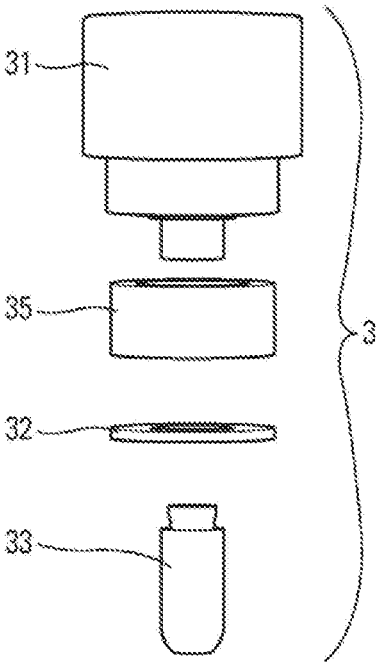
FIG. 6 is an exploded perspective view of the removable member of the invention.

Reference is made below to FIG. 6 in order to describe in detail an embodiment of the removable member 3. The member 3 includes a grip head 31 that the user can grip manually. The grip head 31 is provided with a movable magnet 35 that is, nevertheless, secured in stationary manner to the head. The removable member also includes a sealing gasket 32 that extends just below the movable magnet 35. Finally, the removable member 3 includes a fluid applicator 33 that internally defines an extraction and application space 34 in the form of a downwardly-open blind hole. In FIG. 1, the removable member 3 can be seen in the assembled rest position in which the two magnets 15 and 35 are separated only by the sealing gasket 32. It should also be observed that the applicator 33 is engaged in leaktight manner inside the scraper lip 14, as well as inside the guide sleeve 12. The free bottom end of the applicator 33 projects downwards below the sleeve 12, inside the neck 21 of the reservoir 2. In this assembled rest configuration, it can easily be understood that the axial magnetic attraction compresses the sealing gasket 32, and that the scraper lip 14 prevents any fluid from leaking between the base part 1 and the removable member 3. It should also be understood that removing the removable member 3 from the base part 1 requires the magnetic force generated by the magnets 15 and 35 to be overcome.

Figure 4:
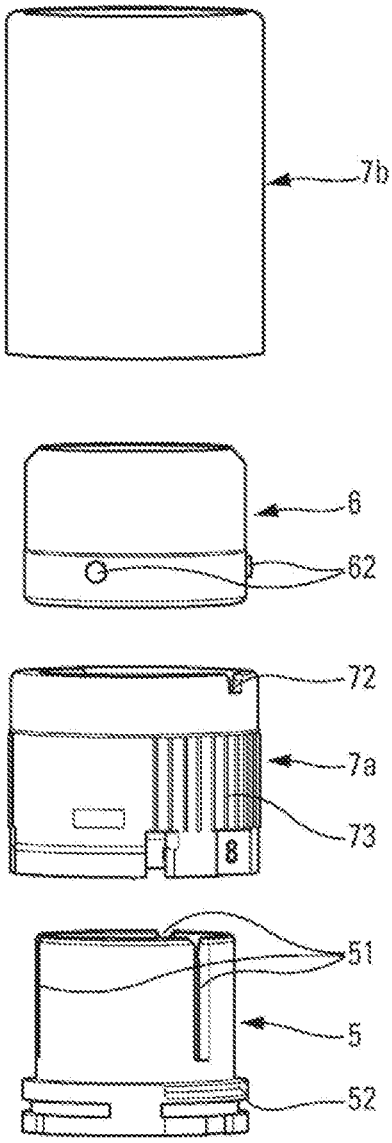
FIG. 4 is an exploded perspective view of mover means of the invention.
Figure 5:
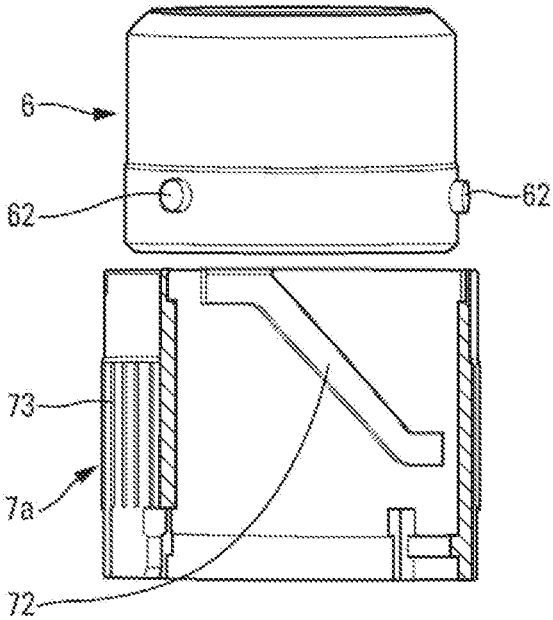
FIG. 5 is an exploded and cut-away perspective view showing the interaction between two parts of the mover means.

To do this, the present invention implements mover means 4 that act between the base part 1 and the removable member 3 so as to move the removable member 3 away from the assembled rest position in which the magnetic attraction is at its maximum. The mover means 4 are distinct both from the base part 1 and from the removable member 3. The mover means 4 comprise three main component elements, namely an axial guide bushing 5, an axial thrust cylinder 6, and an actuator member 7. Relative to the reservoir 2, the bushing 5 is stationary, the cylinder 6 is movable axially but without turning, and the actuator member 7 is movable in turning but without any axial component. With reference also to FIGS. 4 and 5, it can be seen that the bushing 5 includes at least one axial slot or cut-out 51 that is upwardly open. In FIG. 4, it is possible to distinguish three axial cut-outs 51 that are distributed around the bushing 5. In this embodiment, the axial cut-outs 51 are in the form of deep slots or notches that are upwardly open and downwardly closed. The axial cut-outs could also be in the form of vertical axial grooves that are formed in the inside wall of the bushing 5. At its bottom end, the bushing 5 is also provided with a snap-fastener profile 52 having a function that is explained below. As can be seen in FIGS. 1 and 2, the bushing 5 is engaged around the fastener ring 10, in particular at its skirt 11, so as to block it or lock it around the neck 21 of the reservoir 2. Provision could even be made to snap-fasten the bushing 5 below the skirt 11 of the ring 10. In some circumstances, it is important for the bushing 5 to urge the skirt 11 hard against the neck 21, and more particularly below the projecting annular reinforcement 22. It should also be observed that the top end of the bushing projects vertically upwards beyond the fastener ring 10.

The inside of the axial thrust cylinder 6 defines a plurality of axial guide splines 61 that are engaged in the axial cut-outs 51 of the bushing 5. This can be seen in FIGS. 1 and 2. On its outer face, the cylinder 6 includes a plurality of lugs 62 that project radially outwards. From FIGS. 4 and 5, it is possible to understand that there are three lugs 62 distributed around the cylinder 6.

The actuator member 7 could be made as a single piece, but, as in the embodiment shown in the figures, it is preferably made up of two pieces, namely an inner ring 7*a* and an outer hoop 7*b* that is engaged around the inner ring 7*a*. The inner ring 7*a* may be made by injection-molding a plastics material, whereas the outer hoop 7*b* may be made of metal. In order to improve the retention of the hoop 7*b* on the inner ring 7*a*, it is possible to provide vertical splines 73 at the outer face of the outer ring 7*a*. The outer ring 7*a* is engaged with the snap-fastener profile 52 of the bushing 5 while enabling it to turn over a determined angular stroke. Internally, the outer ring 7*a* forms at least one sloping ramp 72. From the figures, it is possible to understand that three sloping ramps 72 are formed in the inside wall of the outer ring 7*a*. The sloping ramps 72 open upwards, i.e. at the top edge of the outer ring 7*a*. Thus, it is possible to engage the lugs 62 of the cylinder 6 inside the ramps 72 by inserting them via the open top end of the ramps. As a result, the axial thrust cylinder 6 is engaged both with the bushing 5 at the axial splines 61 and with the outer ring 7*a* at the sloping ramps 72. The cylinder 6 is thus arranged around the bushing 5 and inside the outer ring 7*a*.

Thus, it can readily be understood that turning the actuator member 7, by gripping it by its hoop 7*b*, constrains the lugs 62 to move along the ramps 72, given that the cylinder 6 is prevented from turning by the guide splines 61 being engaged in the axial cut-outs 51 of the bushing 5.

In the assembled rest configuration in FIG. 1, the lugs 62 are situated at the bottom ends of the ramps 72, and the guide splines 61 are fully engaged in the axial cut-outs 51. The top end of the cylinder 6 is positioned below the shoulder 36 of the removable member 3, without pushing against it. It is not possible to grip the grip head 31, given that it is received entirely inside the actuator member 7, and more particularly the hoop 7*b*.

By gripping the hoop 7*b* and by causing it to turn about its own axis, the cylinder 6 is constrained to move upwards, as a result of the lugs 62 moving along the ramps 72. The cylinder 6 thus moves axially upwards, without any turning component, thus exerting an axial thrust on the removable member 3, as a result of its engagement below the shoulder 36. As a result, the gap between the magnets 15 and 35 increases and the magnetic attraction decreases until it becomes imperceptible. The grip head 31 thus projects far out from the actuator member, and the user can grip it so as to separate the removable member 3 completely from the remainder of the dispenser. The user can then place the content of the space 34 on a desired application surface merely by putting the applicator 33 into contact with the surface. While the applicator 33 is being removed, said applicator is completely clean, given that it has been scraped by the lip 14. In addition, the movement of the removable member 3 is completely axial given that it is guided not only by the cylinder 6, but also by the sleeve 12.

The user is not aware that there are magnets in the dispenser, even when the turning of the hoop meets a certain amount of resistance that comes from the magnetic attraction, which resistance decreases quickly once turning begins. The mover means also make it possible to increase the force necessary to pull off the removable member. Specifically, the turning movement of the hoop is much gentler than direct axial traction on the removable member.

When the user wishes to put the removable member back in place on the base part, it should be placed in the hoop 7*b* on the cylinder 6. In the invention, gravity combined with magnetic attraction are sufficient for the removable member to return by itself to its place on the base part 1, by driving the mover means in the opposite direction. It is possible to envisage that the user needs to press a little on the removable member until sensing that the removable member is moving by itself under the action of gravity and of magnetic attraction. It is possible to omit the lip 14 so as to reduce friction forces. This imparts a surprising effect, since the magnets are masked and practically imperceptible while the removable member is being removed.

The present invention is illustrated with reference to a base part 1 that is mounted on a reservoir neck, and to a removable member 3 in the form of an applicator stopper. However, without going beyond the ambit of the invention, it is possible to imagine a base part 1 that is mounted on another element, and a removable member 3 that may be in the form of a simple stopper or a protective cap, or even a pusher that is mounted on the actuator rod of a pump or a valve.

The invention thus provides a device having magnetic closure, but in which opening is facilitated by a mechanical cam that makes it possible to transform turning movement of an actuator member into the axial movement in translation of the removable member.

The invention claimed is:

1. A device comprising a base part (1) and a removable member (3) that is mounted in removable manner on the base part (1), the base part (1) and the removable member (3) including magnetic means (15, 35) for generating axial magnetic attraction between the base part and the removable member that is at a maximum in an assembled rest position;

the device further comprises mover means (4), distinct from the removable member (3), for moving the removable member (3) axially away from the base part (1), starting from the assembled rest position, by turning an actuator member (7) that forms part of the mover means (4), so as to reduce the magnetic attraction between the base part (1) and the removable member (3), and thus facilitate the removal of the removable member (3); and wherein the device is configured such that rotation of the actuator member (7) causes removable member (3) to lift axially without rotating and thereby move axially away from the base part.

2. The device according to claim 1, wherein the mover means (4) comprise an axial guide bushing (5) that is mounted in stationary manner on the base part (1), an axial thrust cylinder (6) that is guided axially by the axial guide bushing (5), and the actuator member (7) that is rotatably mounted on the axial guide bushing (5), cam means (62, 72) being provided between the actuator member (7) and the axial thrust cylinder so as to urge the axial thrust cylinder (6) in axial movement guided by the axial guide bushing (5) while the actuator member (7) is being turned.

3. The device according to claim 2, wherein the axial guide bushing (5) includes at least one axial cut-out (51), and the axial thrust cylinder (6) includes at least one axial guide profile (61) that is engaged in said at least one axial cut-out (51) so as to guide the axial thrust cylinder (6) in axial movement, while preventing it from turning.

4. The device according to claim 2, wherein the cam means comprise at least one sloping ramp (72) that is formed by the actuator member (7), and the axial thrust cylinder (6) includes at least one lug (62) that is engaged in said at least one sloping ramp (72) so as to force the lug (62) to move along the sloping ramp (72) while the actuator member (7) is turning.

5. The device according to claim 4, wherein the sloping ramp (72) presents a slope such that the removable member (3) returns automatically to the assembled rest position under the action of magnetic attraction, when it is placed on the axial thrust cylinder (6).

6. The device according to claim 1, wherein the actuator member (7) comprises an inner ring (7*a*) that forms at least one sloping ramp (72), and an outer hoop (7*b*) that is engaged around the inner ring (7*a*).

7. The device according to claim 1, wherein the base part (1) is mounted on a neck (21) of a reservoir (2), and the removable member (3) is selected from stoppers, applicators, and protective caps.

8. The device according to claim 7, wherein the base part (1) includes a skirt (11) that is engaged around the neck (21) of the reservoir (1), an axial guide bushing (5) being mounted around the skirt (11) so as to block the skirt around the neck (1).

9. The device according to claim 7, wherein the removable member (3) includes a blind extraction and application space (34) that is engaged in the neck (11) of the reservoir (1) in the assembled rest position.

10. The device according to claim 1, wherein the removable member (3) is received entirely in the actuator member (7) in the assembled rest position.

11. The device according to claim 1, wherein the magnetic means comprise a permanent magnet (15) that is secured to the base part (1) and a movable magnet (35) that is secured to the removable member (3), a sealing gasket (32) being interposed between the two magnets (15, 35) in the assembled rest position so as to be flattened by the axial magnetic attraction.

12. The device according to claim 1, wherein the removable member (3) includes a shoulder (36) below which an axial thrust cylinder (6) is engaged.

13. A fluid dispensing device comprising:

a reservoir;

a base part secured to the reservoir and having an opening to an inside of the reservoir;

a closure mounted in removable manner on the base part, each of the base part and the closure including a respective magnet arranged so that the base part and the closure are held together by an axial magnetic attraction between the respective magnets when closure is mounted on the base part; and a moving mechanism, distinct from the closure, that moves the closure axially away from the base part, the moving mechanism comprising an axial guide bushing mounted in stationary manner on the base part, an axial thrust cylinder guided axially by the axial guide bushing, an actuator member rotatably mounted on the axial guide bushing (5), a cam between the actuator member and the axial thrust cylinder oriented to urge the axial thrust cylinder in axial movement guided by the axial guide bushing while the actuator member is being turned, such that turning the actuator member reduces the axial magnetic attraction between the base part and closure and thereby facilitates complete separation of the closure from the base part.

* * * * *